United States Patent [19]

Fuller

[11] 3,972,094

[45] Aug. 3, 1976

[54] DEVICE FOR SECURING AND STORING PAIRED SOCKS

[76] Inventor: Kenneth J. Fuller, 813 Ceader Ave., Drexel Hill, Pa. 19026

[22] Filed: Apr. 7, 1975

[21] Appl. No.: 565,836

[52] U.S. Cl. ..... 24/150 SP; 24/DIG. 29; 211/10

[51] Int. Cl.[2] ..... A44B 9/00; B42F 17/00

[58] Field of Search ..... 24/259 A, 150 SP, 150 FC, 24/DIG. 29; 206/278, 289, 290, 291, 284, 285; 211/10, 11, 36, 113; 223/DIG. 1, 85, 87

[56] References Cited

UNITED STATES PATENTS

| | | | |
|---|---|---|---|
| 1,343,423 | 6/1920 | Todd | 211/10 X |
| 1,588,709 | 6/1926 | Dinkelbihler | 24/DIG. 29 |
| 1,625,551 | 4/1927 | Lane | 24/150 SP UX |
| 1,843,547 | 2/1932 | Dukes et al. | 223/87 |
| 2,045,666 | 6/1936 | McPhee | 24/150 SP |
| 2,953,828 | 9/1960 | Hochman | 24/DIG. 29 |
| 3,329,386 | 7/1967 | Rosen | 223/87 UX |
| 3,414,944 | 12/1968 | Rabinowitz | 24/DIG. 29 UX |

FOREIGN PATENTS OR APPLICATIONS

| | | | |
|---|---|---|---|
| 255,550 | 1/1913 | Germany | 206/290 |

*Primary Examiner*—Donald A. Griffin
*Attorney, Agent, or Firm*—Robert S. Lipton

[57] ABSTRACT

A device is disclosed for securing a matched pair of socks, particularly during laundering, and for storing them after the laundering is completed. The socks are secured by a clip having three lips forming an integral part thereof. A compartmentalized box is provided for storing the secured socks. The box is adapted to engage the lips on the clip.

4 Claims, 7 Drawing Figures

DEVICE FOR SECURING AND STORING PAIRED SOCKS

BACKGROUND OF THE INVENTION

This invention relates to a device for securing and storing paired socks. More particularly, the invention relates to a device for securing socks so that they do not become separated during laundering. The device neatly stores the secured socks to aid in selection after they have been laundered.

The sorting of socks into their proper pairs after laundering is both tedious and time-consuming. This is especially true in the case of different pairs of socks which are similar in color and texture. Generally, proper matching of such pairs of socks requires the use of natural light or high illumination artifical light.

Once the socks are properly paired they must be either folded or have one sock stuffed into the other so as to prevent them from being separated. This is also tedious and time-consuming. After pairing, securing, folding or the like, the socks are then stored. Storing usually involves placing the socks in a drawer or on a shelf. The wearer then encounters the problem of properly selecting the pair of socks to wear. Since the upper portion of socks frequently have a design or pattern substantially different from the foot of the sock, selection becomes difficult as frequently the socks are stored so that only the foot is visible.

Devices are known in the prior art which perform some of the functions of the present invention. Connectors exist which secure the socks of a matched pair together for laundering. However, these connectors do not facilitate the storing of the socks subsequent to laundering. Some of these connecting devices require that the socks themselves be modified. Some of these prior art connectors crumple or bunch the socks together while securing them. This is undesirable as that portion of the sock which is tightly crumpled does not dry as soon as the remaining portion of the sock and is wrinkled when it does dry.

SUMMARY OF THE INVENTION

Accordingly, it is an object of the present invention to provide a device which both secures a matched pair of socks, particularly during laundering, and stores them.

It is an object of the present invention to provide a device for securing and storing matched pairs of socks which does not require the modification or alteration of the socks.

It is a further object of the invention to provide a device for securing a matched pair of socks, particularly during laundering, which will not bunch or crumple the socks.

It is a further object of the invention to provide a device for storing the laundered socks so that both the upper portion and the foot of the sock are visible, thus making the selection of a particular pair of socks expedient.

The present invention meets the aforesaid objects by providing a clip for securing a pair of socks and a box which is adapted to receive clips for storing the socks. The clip has three lips which engage the box. In operation, the socks of a matched pair are symmetrically placed adjacent to one another and folded over the open portion of the clip. The clip is then closed securing the socks in a substantially folded position across their entire width. The socks are then laundered and are kept secure during the laundering process. Subsequent to laundering, the socks secured by the clip, are positioned in the box by appropriately placing the three lips of the clip into slots in the box.

DESCRIPTION OF THE PREFERRED EMBODIMENT

Figure 1:
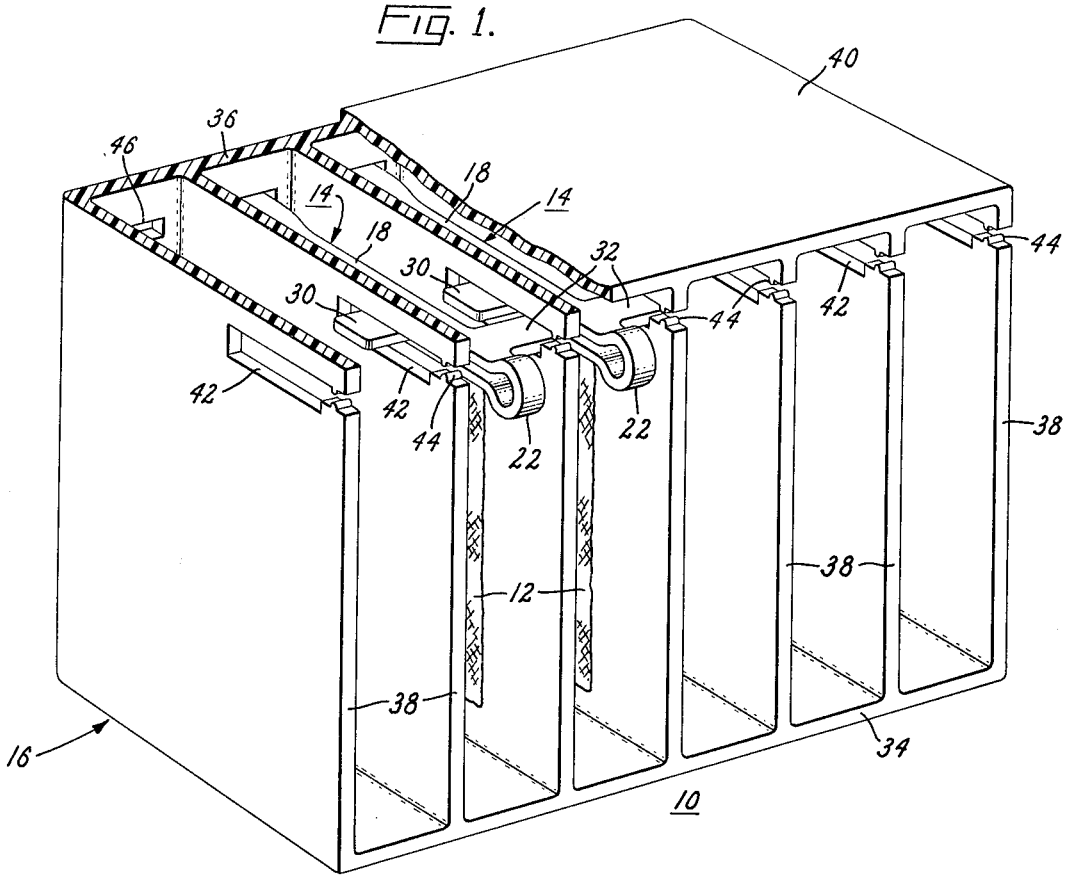
FIG. 1 is a perspective view of the present invention showing the laundered socks secured by clips, positioned in a box.

The present invention 10 is shown in FIG. 1 in its configuration for storing socks 12. Clips 14 are shown positioned in a box 16 for storage. The box 16 is made to receive and secure the clips 14. This may be accomplished in many different ways. In the preferred embodiment the clip is made with lips that are received by slots in the box.

Figure 2:
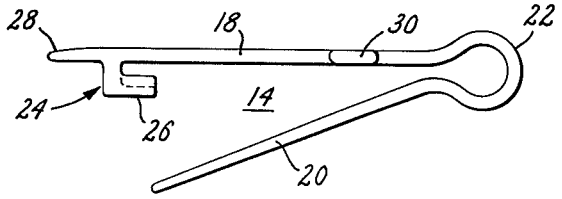
FIG. 2 is a side elevation view of a clip in its open configuration.
Figure 3:
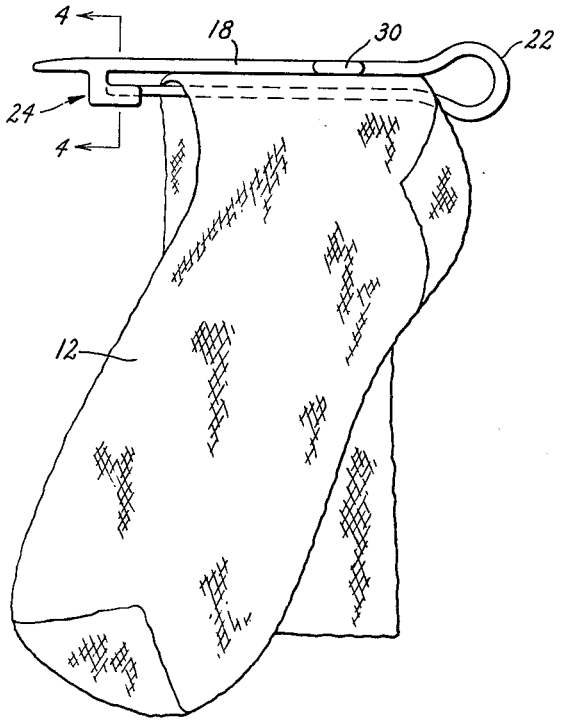
FIG. 3 is a side elevation view of a clip in its closed position securing a pair of socks.
Figure 4:
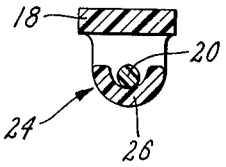
FIG. 4 is a section view taken along line 4—4 in FIG. 3.
Figure 5:
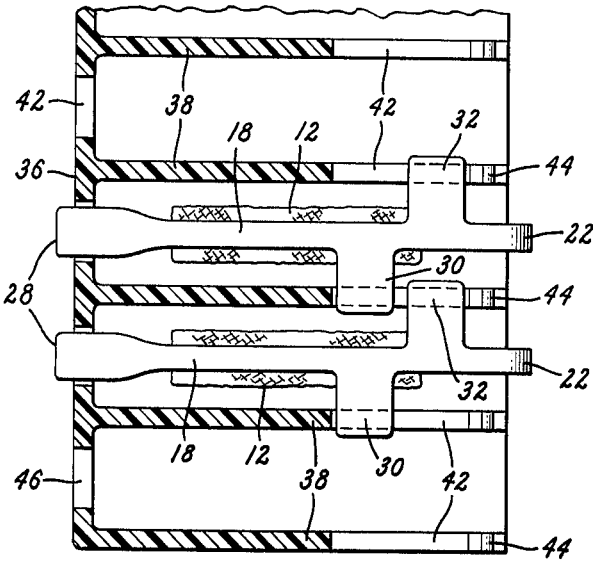
FIG. 5 is a view taken along line 5—5 in FIG. 6.
Figure 6:
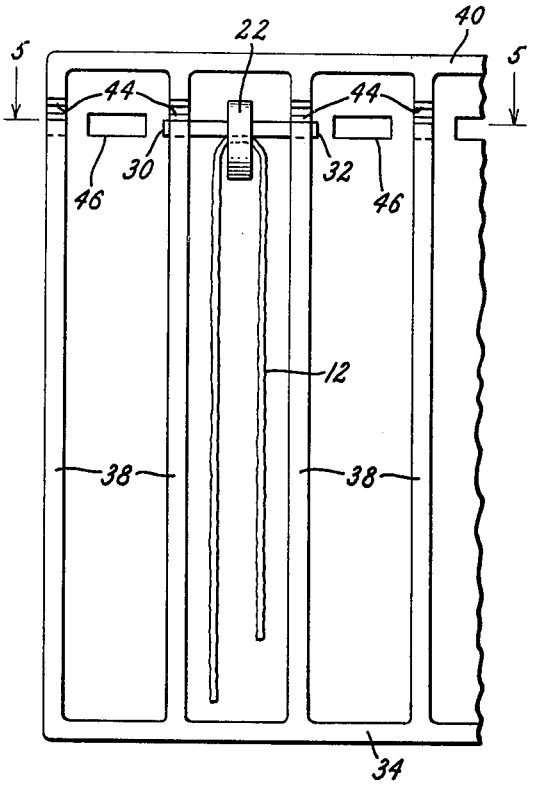
FIG. 6 is a front elevation view of the invention as shown in FIG. 1.
Figure 7:
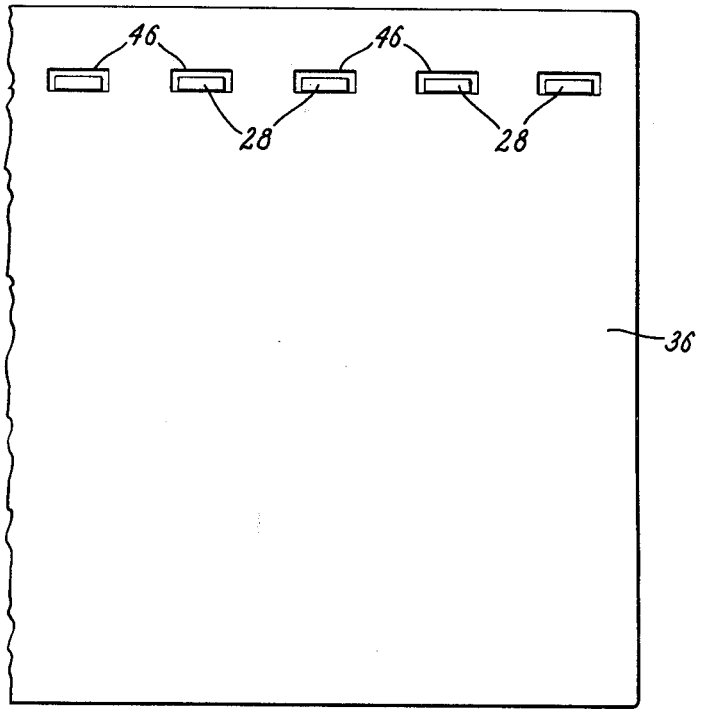
FIG. 7 is a portion of a rear view of the invention as shown in FIG. 1, showing one of the lips of a clip protruding through a slot in the rear of the box.

A clip 14 of the present invention is shown in FIGS. 2, 3, and 4. The clip 14 includes a primary member 18 connected to a closing member 20 by an apex member 22. A clasp 24 is connected to the primary member 18 at the end thereof opposite the apex 22 to secure the closure member 18 in the closed position as shown in FIG. 3.

The clasp includes a U-shaped portion 26 for engaging the end of the closure member 20. This may be best seen in FIG. 4 which is a section view taken along line 4—4 in FIG. 3.

Clip 14 includes lips for securing it to the box 16. An end lip 28 is connected to the end of the primary member 18. Lateral lips 30 and 32 are connected to the primary member at the end thereof opposite the clasp 22. For reasons which will subsequently be described, one of the lateral lips is positioned ahead of the other one.

The clip 14 may be made of various materials and constructions. The clasp 22 and the lips may be made separately and then attached to the primary member 18 or they made be made integral therewith. It is possible to construct the clip in much the same manner as an ordinary safety pin, with the addition of the lips. In the preferred embodiment of the invention the clip is made of molded plastic with the clasp and the lips formed integral therewith.

It is desirable that the apex 22 of the clip be designed so that when the closure member 22 is unsecured by the clasp 24 the clip remains in the open position as shown in FIG. 2. This facilitates the placing of the paired socks in the clip.

The primary member 18, the apex 22 and the closure member 20, may be initially manufactured as a single straight member and subsequently formed into the configuration shown in FIG. 2. This is accomplished by heating the straight member and bending it so as to form the clip in its open position. The apex is thus formed so that it inherently causes the unclasped closure member 22 to remain in the open position.

The box 16 of the present invention is shown in FIGS. 1, 5, 6, and 7. The box is used for storage purposes to keep the laundered socks in an orderly and wrinkle-free arrangement subsequent to laundering. The box 16 includes a base 34, a back portion 36, and walls 38. The box is shown with a top 40, however, this is optional and may be eliminated to save manufacturing costs. However, an advantage of having the top is that it can be used as a shelf or to facilitate the stacking of additional boxes.

Each of the walls 38 is made with a slot 42. Dimples 44 are positioned at the upper and lower surfaces of the slot 42 a short distance inside the opening. The dimples are used to secure the clip in the box. The width of the slot should be at least twice the thickness of the lateral lips 30 and 32.

The back portion 36 has slots 46 positioned therein midway between the walls 38 and at the same height from the base 34 as the slots 42. The length and width of the slot 46 should be sufficiently large so as to enable the end lip 28 of the clip 14 to pass through.

During normal use each slot 42 will receive a lateral lip 30 from one clip and a lateral lip 32 from another clip. This accomplished, as previously mentioned, by constructing the clip 14 so that lateral lip 30 is ahead of lateral lip 32. Since the width of each slot is more than twice the thickness of one of the lateral lips, one of the clips 14 may be removed from the box 16 without disturbing an adjacent clip.

In using the present invention the soiled socks are mated and folded over the closure portion 20 of the clip 14. The end of the closure 20 is then engaged by the clasp 24 thereby securing the individual socks of the pair together. The socks, secured by the clip, are then laundered.

Subsequent to laundering the socks are then organized neatly and efficiently by placing them in the box 16 while still secured by clips 14. This is accomplished by inserting the end lip 28 into the slot 46 in the back of the box 16 and forcing the lateral lips past the dimples 44 into the slots 42. The gap between dimples 44 is slightly less than the thickness of lateral lips 30 and 32. By inserting the lateral lips into the slot 42 the dimples 44 are forceably separated. Once the lateral lips have entered the slot and passed the dimples, the dimples return to their normal position thus securing the clip 14 in the box 16. Thus movement or tilting of the box will not cause the clips 14 to become dislodged from the box.

To remove a pair of laundered, clipped socks from the box, the clip is lifted in the slots 42, passed over the lateral lips of any adjacent clips and forced past dimples 44.

In using the present invention, it is contemplated that each family member will have a box for storing his socks. The clips 14 should be made available in a variety of colors so that each family member can have a clip of a different color. This will greatly facilitate the sorting of the laundered pairs of sock according to their owner. Subsequent to the sorting, the sock will be stored in their respective owner's box.

It is readily apparent that the clips 14 will continually be recycled. As laundered socks become unclipped, that clip may be used to secure a soiled pair of socks prior to laundering. A separate container may be provided for loose and unused clips. This container may be affixed or secured to one side of the box 16.

The box 16 is shown in FIG. 1 with only one row of secured socks. The height of the box can be increased by increasing the height of the walls 38 and the back portion 36 so as to provide any number of desired rows. In a similar manner, the width of the box may be lengthened simply by adding additional walls.

The box may be made a number of different ways and from a number of different materials. In the preferred embodiment the box is made of molded plastic with the base 34 and walls 38 made in one integral piece. The back portion 36 and the top 40 are connected separately to the walls and base thus forming the completed structure. The slot 42 and dimples 44 may be formed during the manufacture of the walls 38 or formed as a separate manufacturing step.

Numerous variations and modifications of the above described invention will occur to those skilled in the art in light of this disclosure and the prior art. It is contemplated, therefore, that the present invention may be practiced otherwise than specifically described herein while remaining within the scope of the following claims which define the invention.

What is claimed is:

1. A device for securing, particularly during laundering, and storing paired socks which comprises: a clip having, first and second members for securing the paired socks therebetween, an apex member connected to one end of each of said first and second members, a clasp connected to the end of said first member opposite the end connected to said apex member for receiving and securing the end of said second member opposite the end of said second member connected to said apex member, and first connecting means connected to said clip; and a box having a base; a back connected to said base, and a pair of walls connected to said base and to said back, and second connecting means for engaging said first connecting means thereby securing said clip to said box.

2. The device of claim 1 wherein; said first connecting means includes a first lip connected to the end of said first member opposite the end thereof connected to said apex member, said first lip projecting beyond said clasp, second and third lip members connected to said first member towards the end thereof connected to said apex member; said back has a slot formed therein between said pair of walls; and each wall of said pair of walls has a slot therein for receiving said second and third lip members.

3. The device of claim 2 wherein; a first dimple is secured to the upper surface of said slot in each wall near the opening thereof; and a second dimple is secured to the lower surface of said slot in each wall near the opening thereof opposite said first dimple, the distance between said dimples being slightly less than the thickness of said second and third lip members whereby said dimples secure second and third lips in said slots in said walls.

4. The device of claim 2 wherein said second lip is positioned ahead of said third lip such that the rear edge of said second lip is ahead of the forward edge of said third lip.

* * * * *